United States Patent [19]

Flaherty

[11] Patent Number: 4,633,133

[45] Date of Patent: Dec. 30, 1986

[54] FLUORESCENT LAMPS HAVING IMPROVED LAMP SPECTRAL OUTPUT AND MAINTENANCE AND METHOD OF MAKING SAME

[75] Inventor: John M. Flaherty, Danvers, Mass.

[73] Assignee: GTE Products Corporation, Stamford, Conn.

[21] Appl. No.: 671,133

[22] Filed: Nov. 13, 1984

[51] Int. Cl.[4] ..... H01J 61/35

[52] U.S. Cl. ..... 313/489; 313/486

[58] Field of Search ..... 313/486, 489, 485

[56] References Cited

U.S. PATENT DOCUMENTS 4,459,507 7/1984 Flaherty ..... 313/486 X

FOREIGN PATENT DOCUMENTS 112064 9/1981 Japan ..... 313/486

*Primary Examiner*—David K. Moore
*Assistant Examiner*—K. Wieder
*Attorney, Agent, or Firm*—Carlo S. Bessone

[57] ABSTRACT

Lumen maintenance and spectral output of fluorescent lamps is improved by applying over the phosphor a vapor deposited film consisting of yttrium oxide and at least one activator. The vapor is generated by electron beam bombardment of the activated yttrium oxide target and the film is most efficacious when applied to a thickness of from about 0.2 microns to about 1.5 microns.

6 Claims, 4 Drawing Figures

FLUORESCENT LAMPS HAVING IMPROVED LAMP SPECTRAL OUTPUT AND MAINTENANCE AND METHOD OF MAKING SAME

CROSS-REFERENCE TO RELATED APPLICATIONS

The application discloses, but does not claim, inventions which are claimed in U.S. Ser. No. 671,137 filed concurrently herewith, and assigned to the Assignee of this application.

TECHNICAL FIELD

This invention relates to fluorescent lamps and more particularly to such lamps having improved lamp spectral output and maintenance and to methods for making the lamps.

BACKGROUND ART

Fluorescent lamps are well known light sources famous for their high light output and relatively long life. Such lamps comprise a tubular, hermetically sealed, glass envelope having electrodes sealed in the ends thereof. An arc generating and sustaining medium, usually at low pressure, and comprising one or more inert gases such as argon, krypton, etc., or mixtures thereof, together with a small amount of mercury, is present in the envelope. The interior of the envelope is coated with a layer of phosphor which will absorb various forms of energy generated by the arc (usually wavelengths of ultraviolet) and reemit this energy in the form of visible light.

These lamps, as well as all other known lamps, suffer from a gradual decrease in light output as they age. The light output of a lamp at any time is given as a fraction or a percentage of the original output and is called the maintenance at that time. Maintenance can be measured in lumens or other arbitrary units. Poor maintenance has been a major factor preventing the successful application of many phosphors.

The conditions that cause the loss in light output are many and include the initial processing conditions where the lamp is baked to temperatures of 600° C. which can cause serious degradation in the performance of some phosphors.

After completion of the lamp, during operation thereof, the phosphor is subjected to the mercury vapor discharge where it is exposed to high energy ultraviolet radiation as well as being bombarded by ions, electrons and atoms. These factors, among others not well understood, contribute to the loss of brightness in fluorescent lamps.

A number of techniques have been suggested to overcome or at least retard the decrease in loss of light output. These techniques have included better processing of the phosphors, and methods to shield the phosphors from the deleterious effects of the lamp processing and arc discharge by the application of a protective film over the phosphor. Various materials for this shielding having included non-continuous particulate films of, for instance, silica and alumina.

A fluorescent lamp incorporating one or more types of finely divided phosphor blended together in its phosphor coating often requires an additional admixture of a different type phosphor to improve the spectral output (i.e., color or color rendering index).

One technique to improve maintenance is described in U.S. Pat. No. 4,459,507, dated July 10, 1984 issued to J. M. Flaherty and assigned to the Assignee of the present application. The patent involves applying a nonluminescent maintenance improving film of yttrium oxide overlying the phosphor. The film does not improve the lamp's spectral output.

While all of the above techniques have provided an improvement in the maintenance, it would be an advance in the art to improve both the spectral output and maintenance of fluorescent lamps.

DISCLOSURE OF THE INVENTION

It is, therefore, an object of the invention to obviate the disadvantages of the prior art.

It is another object of the invention to improve the lamp spectral output and maintenance of fluorescent lamps.

It is still another object of the invention to provide a method for accomplishing these desirable objects.

These objects are accomplished, in one aspect of the invention, by the provision, within a fluorescent lamp, of a lamp spectral output and maintenance improving film consisting of yttrium oxide and at least one activator which overlies the phosphor.

The film is deposited by electron beam vaporization of a target consisting of yttrium oxide and at least one activator. The vapor generated is subsequently deposited as a film upon the phosphor.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
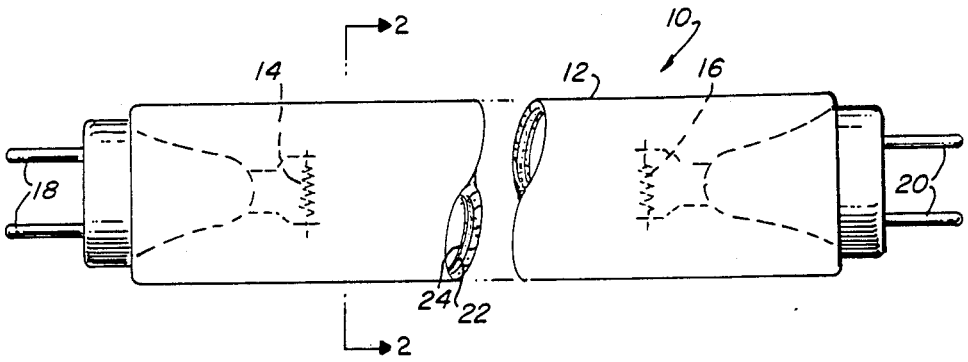
FIG. 1 is a diagrammatic elevational view of a lamp.
Figure 2:
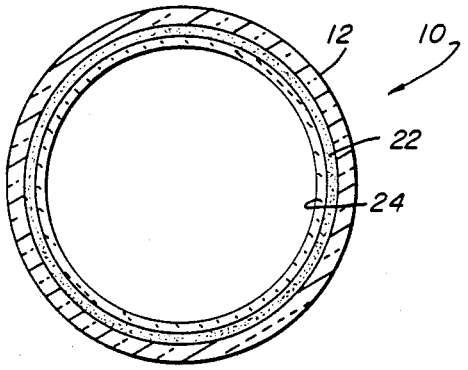
FIG. 2 is a sectional view taken along the line 2—2 of FIG. 1.

Referring now to the drawings with greater particularity, there is shown in FIG. 1 a fluorescent lamp 10 comprising a tubular, hermetically sealed, glass envelope 12. Electrodes 14 and 16 are sealed in the ends of envelope 12. Suitable terminals 18 and 20 are connected to the electrodes 14 and 16 and project from envelope 12. An arc generating and sustaining medium such as one or more inert gases and mercury vapor is included within envelope 12.

A layer of phosphor 22 is applied to the inside surface of envelope 12. While phosphor 22 can be any material useful in fluorescent lamps, the invention herein described is particularly efficacious when the phosphor is manganese activated zinc orthosilicate ($Zn_2SiO_4$:Mn). This phosphor is much employed because of its green emission under the ultraviolet radiation generated within a fluorescent lamp. It is also notorious for its poor maintenance.

To rectify the above problems, a lamp spectral output and maintenance improving film 24 which consists of yttrium oxide and at least one activator is applied over phosphor 22. Activators, as is well known, are positively charged foreign ions added to inorganic crystalline compounds to convert them to efficient fluorescent materials. The activators in the invention may consist of any combination of ions suitable for use with yttrium oxide. It is preferred that the activators are selected from the group of rare-earth elements. It has been discovered that this film, which takes the form of a continuous, non-particulate film, performs a maintenance function as well as provide an improvement in color. The thickness of film 24 should be within a range of from about 0.2 microns to about 1.5 microns. The film 24 is deposited upon phosphor 22 to the desired thickness by electron beam vaporization of a target consisting of yttrium oxide and at least one activator. The vapor generated is subsequently deposited as film 24 on phosphor 22.

As one particular example, tests were accomplished by coating microscope slides with $Zn_2SiO_4$:Mn by conventional slurry technique. The slides were then baked in air for approximately three minutes at 550° C. One half of the phosphor carrying slides was then coated with europium activated yttrium oxide ($Y_2O_3$:Eu) of varying thickness by electron beam bombardment of an europium activated yttrium oxide target.

Figure 3:
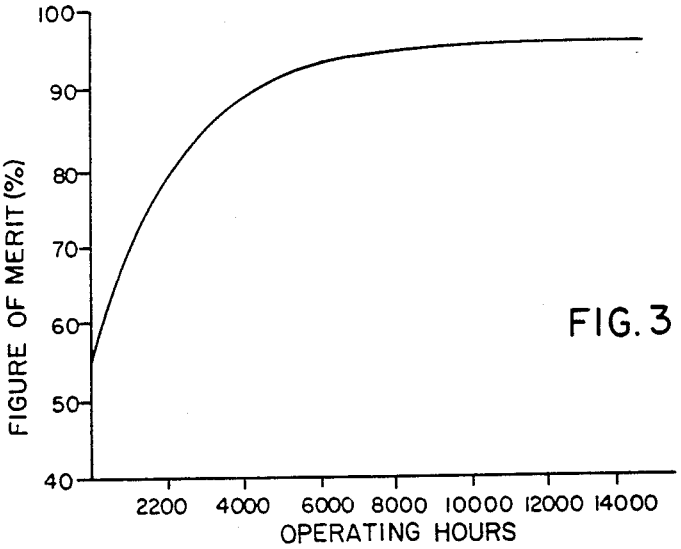
FIG. 3 shows graphically the time dependence of the relative maintenance achieved by utilization of the invention.
Figure 4:
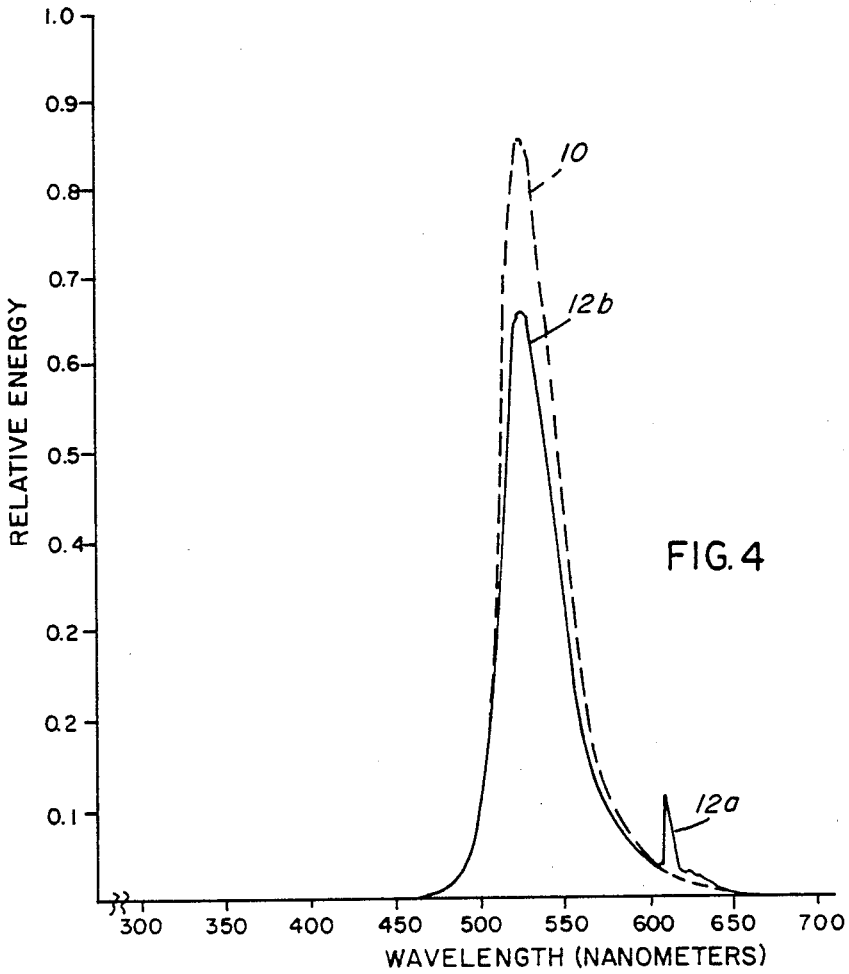
FIG. 4 shows a typical spectral energy distribution of a lamp made in accordance with the invention.

The slides were then inserted and sealed into 4 ft. T12 lamps (40 Watt). The lamps were then operated and the ratio of the brightness of the coated and uncoated phosphor was monitored with time using a brightness spotmeter (FIG. 3). Also, the spectral emission, under 254 nm excitation that characterizes a fluorescent Hg discharge, of the $Zn_2SiO_4$:Mn phosphor incorporating the $Y_2O_3$:Eu luminescent film overcoat, was spectrally recorded (FIG. 4).

FIG. 3 illustrates the improvement derived by employment of the invention. The graph plots data obtained with a thickness of the $Y_2O_3$:Eu film equal to about one micron.

The "Figure of Merit" (FOM) is the ratio of the brightness between coated and uncoated phosphor and is computed as $$FOM = \frac{\text{coated brightness}}{\text{uncoated brightness}} \times 100\%.$$

As can be seen from FIG. 3, the FOM is increasing as the lamps are burning. In other words, the maintenance of the coated phosphor is superior to the uncoated phosphor.

FIG. 4 shows the improved spectral output obtained from the same slide. Dotted line 10 shows the spectral output of the uncoated phosphor while the solid line shows the coated phosphor. The intended spectral addition at the orange-red 610 nm region (12*a*) due to the $Y_2O_3$:Eu coating is illustrated along with the $Zn_2SiO_4$:Mn phosphor's broad band emission peaked at the green 528 nm region (12*b*).

The particular spectral output obtained will depend on the thickness of the film as well as the activators used with the yttrium oxide. For instance, a thinner coating of $Y_2O_3$:Eu will tend to increase the emission in the green region while reducing the red emission. The addition of the activator dysprosium (Dy) will increase the yellow region of the spectrum.

While there have been shown what are at present considered to be the preferred embodiments of the invention, it will be apparent to those skilled in the art that various changes and modifications can be made herein without departing from the scope of the invention as defined by the appended claims.

I claim:

1. A fluorescent lamp comprising:

a tubular, hermetically sealed, glass envelope;

electrodes sealed in the ends of said envelope;

an arc generating and sustaining medium including mercury within said envelope;

a phosphor coating adhering to the interior surface of said envelope; and a spectral output and maintenance improving non-particulate film overlying said phosphor wherein said film consists of yttrium oxide and at least one activator.

2. The lamp of claim 1 wherein said activator is selected from the group of rare-earth elements.

3. The lamp of claim 2 wherein said activator is europium.

4. The lamp of claim 1 wherein said film has a thickness of from about 0.2 microns to about 1.5 microns.

5. The lamp of claim 4 wherein said film has a thickness of about one micron.

6. The lamp of claim 1 wherein said phosphor is manganese activated zinc orthosilicate.

* * * * *